US006656011B2

(12) United States Patent
Yoneda

(10) Patent No.: US 6,656,011 B2
(45) Date of Patent: Dec. 2, 2003

(54) SUSPENSION FOR RUNNING TOY AND RUNNING TOY

(75) Inventor: Yousuke Yoneda, Tokyo (JP)

(73) Assignee: Tomy Company Ltd., Tokyo (JP)

( * ) Notice: Subject to any disclaimer, the term of this patent is extended or adjusted under 35 U.S.C. 154(b) by 97 days.

(21) Appl. No.: 10/056,110

(22) Filed: Jan. 28, 2002

(65) Prior Publication Data

US 2003/0143921 A1 Jul. 31, 2003

(51) Int. Cl.[7] ..... A63H 17/00
(52) U.S. Cl. ..... 446/431; 446/468; 446/454
(58) Field of Search ..... 446/454, 456, 446/457, 460, 465, 466, 468, 471, 431; 280/124.17, 124.171

(56) References Cited

U.S. PATENT DOCUMENTS

| | | | | |
|---|---|---|---|---|
| 1,739,917 A | | 12/1929 | Rayzor | |
| 3,083,499 A | | 4/1963 | Balthazor et al. | |
| 3,751,065 A | | 8/1973 | Sullivan | |
| 3,752,246 A | | 8/1973 | Sullivan | |
| 4,159,126 A | | 6/1979 | Raleigh | |
| 5,306,038 A | | 4/1994 | Henderson, Jr. | |
| 5,322,469 A | * | 6/1994 | Tilbor | 446/454 |
| 5,338,246 A | | 8/1994 | Suto | |
| 5,338,247 A | | 8/1994 | Miles | |
| 5,478,104 A | * | 12/1995 | Worrel et al. | 280/699 |
| 5,785,576 A | * | 7/1998 | Belton | 446/456 |
| 6,428,025 B1 | * | 8/2002 | Suh | 280/124.106 |
| 6,478,655 B2 | | 11/2002 | Wu | |
| 2002/0077025 A1 | | 6/2002 | Wu | |

FOREIGN PATENT DOCUMENTS

| | | | |
|---|---|---|---|
| DE | 2002252 | * | 1/1969 |
| GB | 990585 | | 4/1965 |
| GB | 1072412 | | 6/1967 |
| GB | 1095490 | | 12/1967 |
| GB | 1 443 901 | | 7/1976 |

OTHER PUBLICATIONS

Combined Search and Examination Report issued in counterpart application, GB 0205524.2, Aug. 21, 2002.

* cited by examiner

*Primary Examiner*—Jacob K. Ackun
*Assistant Examiner*—Jamila O Williams
(74) *Attorney, Agent, or Firm*—Staas & Halsey LLP

(57) ABSTRACT

The present invention provides a suspension for a toy and a vehicle toy, which can properly ground right and left wheels. A suspension for a running toy comprises: right and left turning members for turning right and left wheels in clockwise and counterclockwise directions around each predetermined shaft; a connecting member for connecting the right and left turning members with each other, and for constituting a turning pair with each of the right and left turning members; and a biasing member having right and left edge portions, which is supported in a middle of a width direction of the running toy, and which extends on the right and left turning members, the right and left edge portions being elastically deformable vertically; wherein the right and left turning members are turned around the predetermined shaft by shaking the connecting member in right and left directions; the right and left turning members are constructed so as to be movable vertically in a predetermined range; and the turning members are pressed with the right and left edge portions by using a biasing force which is caused by elastically deforming the biasing member, so that the right and left wheels are grounded to a road surface.

12 Claims, 11 Drawing Sheets

SUSPENSION FOR RUNNING TOY AND RUNNING TOY

BACKGROUND OF THE INVENTION

1. Field of the Invention

The present invention relates to a suspension for a running toy and a running toy. For more detail, the present invention relates to a suspension for a running toy and a running toy, which have each simple structure, and can properly ground wheels.

2. Description of Related Art

In recent years, a running toy (such as a vehicle toy) comprising right and left knuckle arms (turning member) for turning right and left steering wheels (wheel) to the right and the left around a predetermined shaft, and a tie rod (connecting member) for connecting the right and left knuckle arms with each other, which constitute a turning pair with the right and left knuckle arms, has been known. The running toy steers by moving the tie rod to the right and the left.

By the way, with regard to the vehicle toy, when the vehicle toy is running, it is required that all the front and rear wheels thereof are grounded in order that the vehicle toy runs steadily.

Therefore, the vehicle toy has been provided with a suspension in an earlier development. This suspension for the vehicle toy is constructed, for example, so that the right and left knuckle arms which are provided with the right and left steering wheels (front wheel) may be movable vertically, and so that each knuckle arm may be provided with a coiled spring. Thus, by using the coiled spring, the suspension absorbs shocks which the front wheels of the vehicle toy receives from a road surface according to bumps of a running surface. In addition, the suspension grounds the right and left front wheels.

As described above, the suspension grounds the right and left steering wheels by using each coiled spring with which the right and left knuckle arms are provided. However, there are many cases that a difference in the characteristics between the right and left coiled springs is caused. Therefore, there is some possibility that the right and left steering wheels are not properly grounded. In this case, there is a problem that the vehicle toy cannot steer steadily. Moreover, because each of the right and left knuckle arms is provided with a coiled spring, the assembly of the suspension is complicated. Furthermore, there is another problem, such as, that the number of components used in the suspension becomes more.

SUMMARY OF THE INVENTION

This invention is accomplished in order to solve the above-described problems. An object of the present invention is to provide a suspension for a toy and a vehicle toy, which can properly ground right and left wheels.

In accordance with the first aspect of the invention, a suspension for a running toy, comprises:

right and left turning members for turning right and left wheels in clockwise and counterclockwise directions around each predetermined shaft;

a connecting member for connecting the right and left turning members with each other, and for constituting a turning pair with each of the right and left turning members; and a biasing member having right and left edge portions, which is supported in a middle of a width direction of the running toy, and which extends on the right and left turning members, the right and left edge portions being elastically deformable vertically;

wherein the right and left turning members are turned around the predetermined shaft by moving the connecting member in right and left directions;

the right and left turning members are constructed so as to be movable vertically in a predetermined range; and the turning members are pressed with the right and left edge portions by using a biasing force which is caused by elastically deforming the biasing member, so that the right and left wheels are grounded to a road surface.

Here, the "biasing member" may be constructed by superimposing a plurality of biasing member pieces, such as leaf springs. However, preferably, the biasing member is constructed by one biasing member piece, such as one leaf spring. Moreover, material for the "biasing member" is not limited to metal. Plastic or the like may be used as the material.

According to the suspension for a running toy, which has such a structure, because the right and left wheels are grounded to the road surface by using a biasing force which is caused by elastically deforming the right and left edge portions of the biasing member, the wheels can be properly grounded to the road surface. The reason for obtaining the above effect is that, because the suspension uses the right and left edge portions of the biasing member, there is little difference in the characteristics relating to the biasing force.

Moreover, because there is no need for providing each of the right and left turning members with a biasing member, the number of components used in the suspension is decreased, and the assembly of the suspension becomes easier.

In accordance with the second aspect of the invention, a suspension for a running toy having a wheel shaft for attaching right and left wheels, comprises:

a biasing member which is elastically deformable vertically, and which contacts with the wheel shaft in a middle of a width direction of the running toy;

wherein the wheel shaft is constructed so as to be movable vertically in a predetermined range, and to perform a seesaw motion by using a contact portion with the biasing member as a fulcrum; and turning members are pressed at the contact portion by using a biasing force which is caused by elastically deforming the biasing member, so that the right and left wheels are grounded to a road surface.

Here, the "biasing member" may be constructed by superimposing a plurality of biasing member pieces, such as leaf springs. However, preferably, the biasing member is constructed by one biasing member piece, such as one leaf spring. Moreover, material for the "biasing member" is not limited to metal. Plastic or the like may be used as the material.

According to the suspension for a running toy, which has such a structure, because the right and left wheels are grounded to the road surface by using a biasing force which is caused by elastically deforming the biasing member provided in the middle of the width direction, the wheels can be properly grounded to the road surface.

Moreover, the number of components used in the suspension is decreased, and the assembly of the suspension becomes easier.

In accordance with the third aspect of the invention, a suspension for a running toy having a wheel shaft for attaching right and left wheels, comprises:

a biasing member which extends on the wheel shaft, and which is supported in a middle of a width direction of the running toy so that right and left edge portions of the biasing member are elastically deformable vertically;

wherein the wheel shaft is constructed so as to be movable vertically in a predetermined range; and the wheel shaft is pressed with the right and left edge portions by using a biasing force of the biasing member, so that the right and left wheels are grounded to a road surface.

According to the suspension for a running toy, which has such a structure, because the right and left wheels are grounded to the road surface by using a biasing force which is caused by elastically deforming the right and left edge portion of the biasing member, the wheels can be properly grounded to the road surface. The reason for obtaining the above effect is that, because the suspension uses the right and left edge portions of the biasing member, there is little difference in the characteristics relating to the biasing force.

Moreover, the number of components used in the suspension is decreased, and the assembly of the suspension becomes easier.

In accordance with the fourth aspect of the invention, a running toy comprises the suspension for a running toy as described in any one of the first to the third aspects.

According to such a running toy, because the running toy comprises any one of the suspensions for a running toy, the wheels can be properly grounded to the road surface.

In this running toy, it is preferable that the biasing member is detachable.

According to the running toy having such a structure, the biasing member can be changed to another one having a different elastic coefficient, in accordance with the state of the road surface.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENTS OF THE INVENTION

Figure 1:
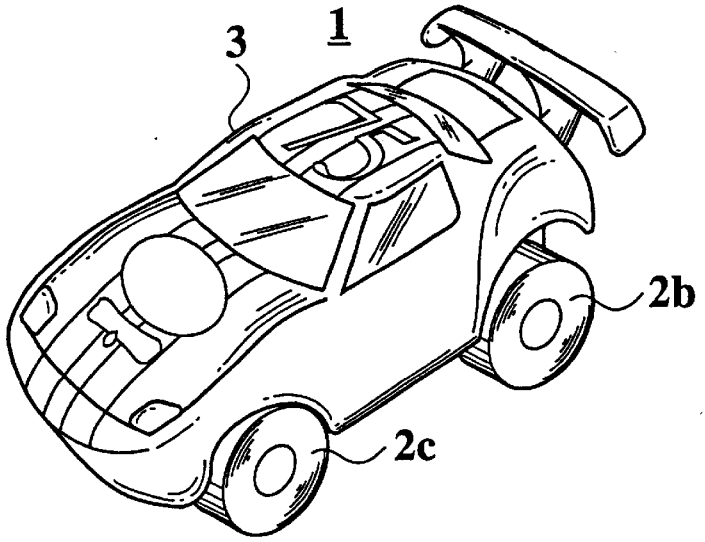
FIG. 1 is a perspective view showing a vehicle toy according to one embodiment of the present invention.
Figure 2:
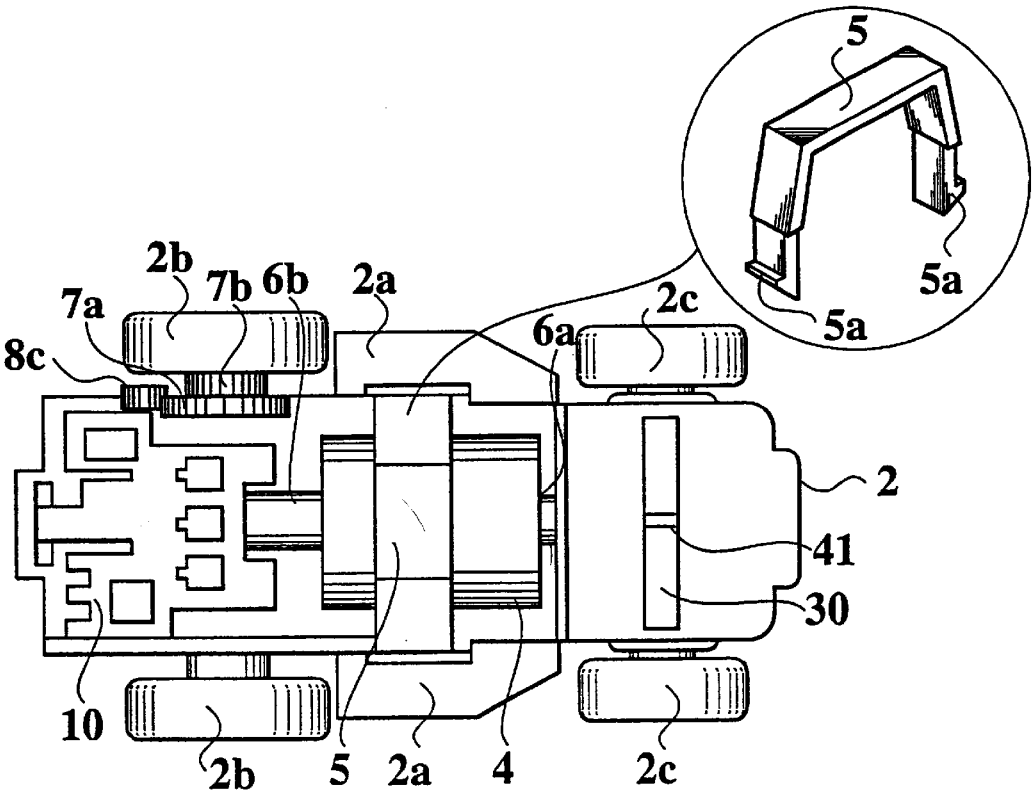
FIG. 2 is a plan view showing a chassis of the vehicle toy shown in FIG. 1.

FIG. 1 is a perspective view of a racing vehicle (racing car) toy to which a suspension for a running toy according to an embodiment is applied. A housing of the vehicle toy 1 includes a chassis (base body) 2 which is shown in FIG. 2 and a body 3. The chassis 2 and the body 3 are formed out of plastic. A front portion and side portions, of the body 3 have some elasticity. The chassis 2 and the body 3 are not limited to the following structures and the like. A recess portion or a hole portion (engaging portion) is provided on an inner side of the front portion and each inner side of the side portions, of the body 3. The body 3 is fixed to the chassis 2 by elastically engaging a projection portion 2*a* of the chassis 2 with the recess portion or the hole portion. The vehicle toy 1 comprises an antenna (not shown in the figure) for receiving a control signal outputted from a controller which is not shown in the figure.

FIG. 2 is a plan view showing the chassis 2. A chargeable battery (for example, Ni-Cd battery) 4 is set to a central portion of the chassis 2 in a state of arranging it longitudinally (so as to direct it to a running direction of the vehicle toy). The battery 4 is attached to a battery containing part (not shown in the figure) by an attachment member 5. The attachment member 5 is formed out of plastic and in an inverted U-shape so as to hold a body part of the battery 4 from the upside. Both free end portions of the attachment member 5 have some elasticity and can be deformed in two directions of coming close to and going away from each other. An engaging pawl (engaging portion) 5*a* is provided on the outer side of each free end portion. The battery 4 is fixed by engaging the engaging pawls 5*a* with each edge (engaging portion) of two hole portions of the chassis 2, which is not shown in the figure. Two conductive pieces 6*a* and 6*b* which can be electrically connected to the positive electrode and the negative electrode, of the battery 4 are provided on the front side and the rear side of the battery containing part. The conductive pieces 6*a* and 6*b* are partially exposed to a lower surface side of the chassis 2. The exposed portions are not shown in the figure. The battery 4 can be charged by using the conductive pieces 6*a* and 6*b* which are partially exposed.

Figure 3:
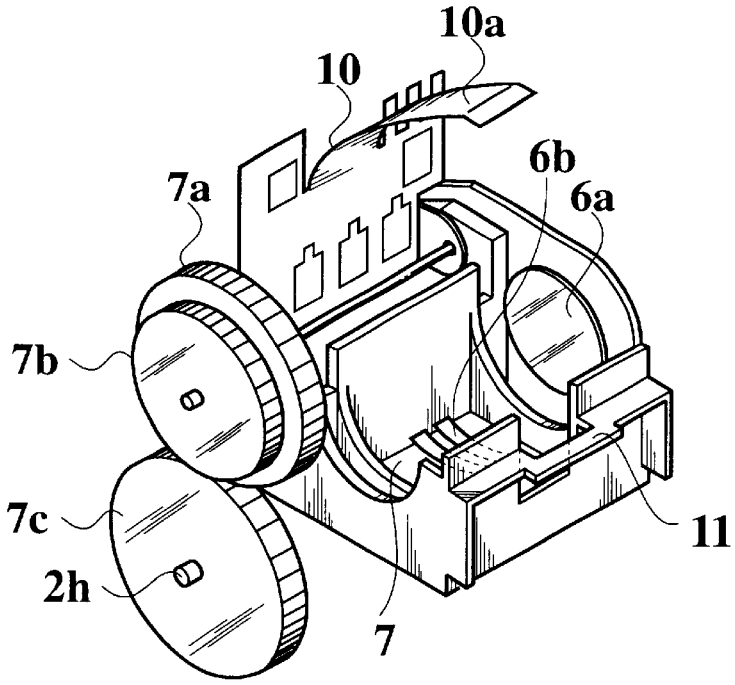
FIG. 3 is a perspective view showing a motor containing part of the vehicle toy shown in FIG. 1.
Figure 4:
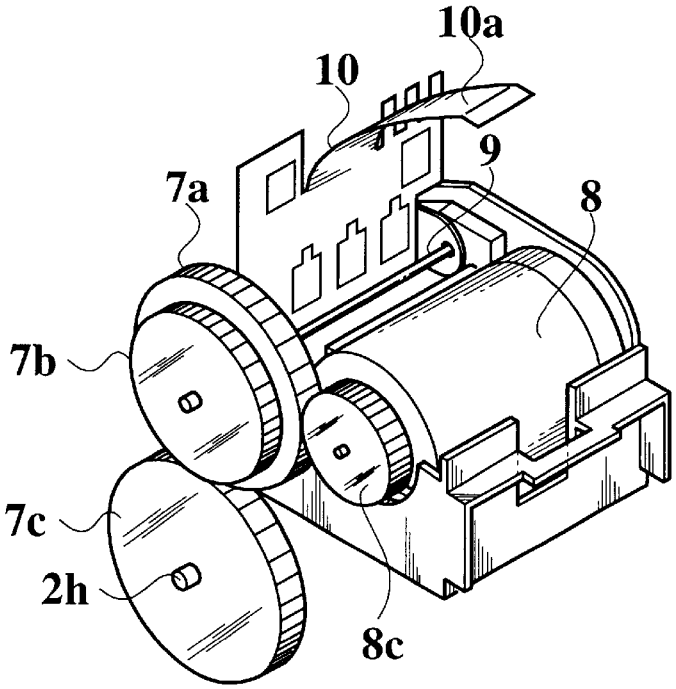
FIG. 4 is a perspective view showing a motor containing part of the vehicle toy shown in FIG. 1.
Figure 5:
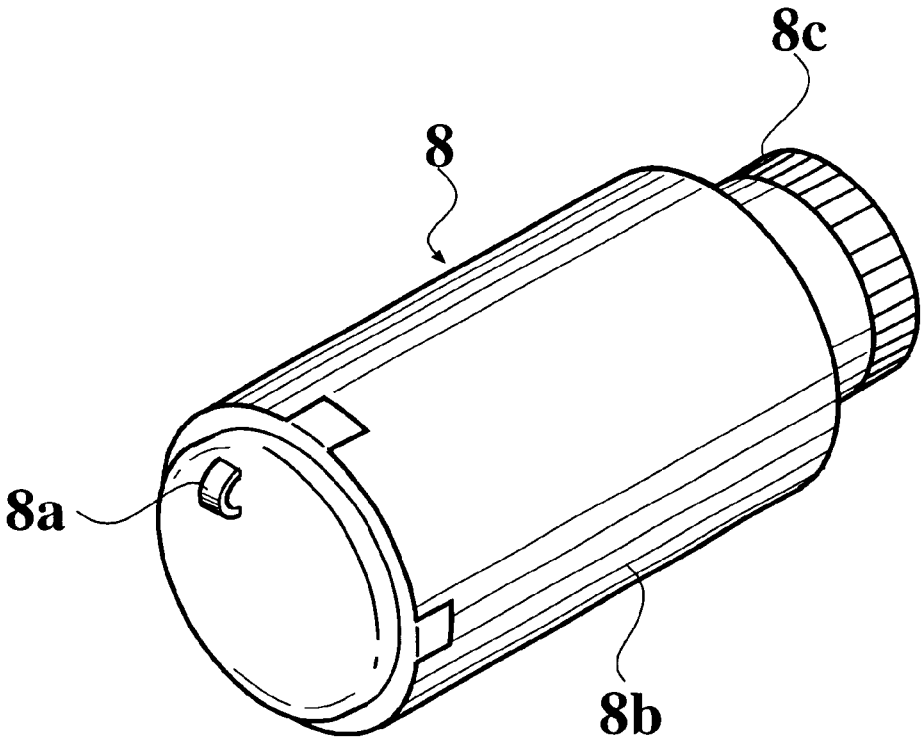
FIG. 5 is a sectional view showing a motor which is used in the vehicle toy shown in FIG. 1.

A motor containing part 7 is provided on a rear portion of the chassis 2 as shown in FIG. 3. As shown in FIG. 4, a motor 8 is set to the motor containing part 7 in a state of arranging it transversally (so as to direct it to a horizontal direction which is normal to the running direction of the vehicle toy). The motor 8 is a DC motor. As shown in FIG. 5, a conductive piece 8*a* is projected from a tail portion of the motor 8. The conductive piece 8*a* constitutes a negative terminal and is electrically connected to the negative electrode of the battery 4. On the other hand, a body part 8*b* of the motor 8 constitutes a positive terminal and is electrically connected to the positive electrode of the battery 4.

Hereinafter, the motor containing part 7 will be explained. The motor containing part 7 is not limited to the following structure. As shown in FIG. 3, one edge of the conductive piece 6*a* which is electrically connected to the negative electrode of the battery 4, is extended to a right side wall of the motor containing part 7. On the other hand, one edge of the conductive piece 6*b* which is electrically connected to the positive electrode of the battery 4, is extended to the bottom of the motor containing part 7. When the motor 8 is set to the motor containing part 7 as shown in FIG. 4, the negative terminal 8*a* projecting from the tail portion of the motor 8 is electrically connected to the conductive piece 6*a* automatically. Further, the positive terminal 8*b* provided on the body part of the motor 8 is electrically connected to the conductive piece 6*b* automatically. A gear 8*c* is fixed to a motor shaft of the motor 8 so as to transmit the rotation of the motor shaft to the gear 8*c*.

A gear 7*a* and a gear 7*b* are set near the left side wall of the motor containing part 7 as shown in FIGS. 2 to 4. These gears 7*a* and 7*b* are unitedly formed out of plastic and are constructed so as to idle themselves around a transversal shaft (a rotational shaft) 9. The gear 7*b* is engaged with a gear 7*c* which is fixedly provided on a rear wheel shaft 2*h* for the rear wheels 2*b* and 2*b*. As a result, the rear wheels 2*b* and 2*b* are rotated by transmitting the power of the motor from the gear 7*a* to the gears 7*b* and 7*c* in order.

Figure 6:
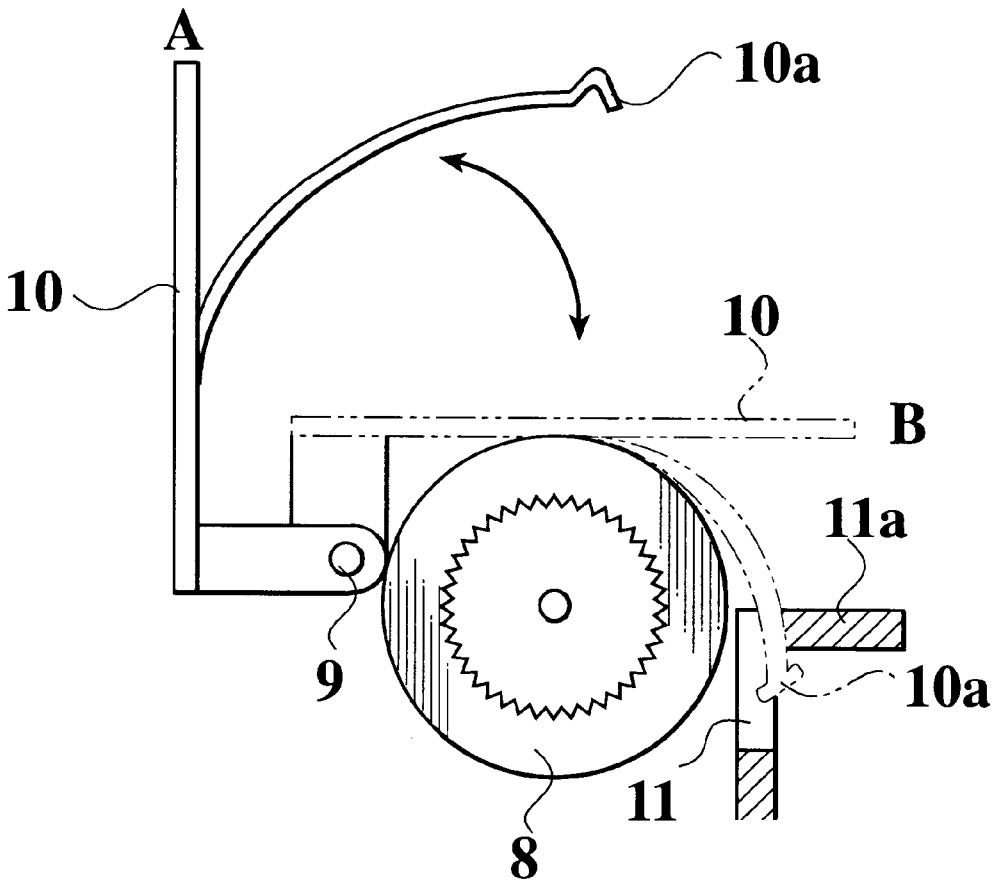
FIG. 6 is a side view showing an open and close state of the motor holding plate of the vehicle toy shown in FIG. 1.

Further, a motor holding plate 10 is provided on the rear portion of the chassis 2 as shown in FIGS. 2 to 4. The motor holding plate 10 is not limited to the following structure. The motor holding plate 10 is formed out of copper. A plurality of slits or holes is suitably provided in order to satisfy both the improvement on the radiation of the motor 8 and the effect of holding the motor 8. The motor holding plate 10 is constructed so as to be rotatable around the transversal shaft 9 extending in a transverse direction on the front side of the motor containing part 7. The motor holding plate 10 is constructed so as to take an open position (A shown in FIG. 6) in which the motr containing part 7 is opened, and a close position (B shown in FIG. 6) in which the motor containing part 7 is closed, by rotating it around the transversal shaft 9. The motor holding plate 10 is constructed so as to hold the body part of the motor 8 set to the motor containing part 7 when the motor holding plate 10 is in the close position.

A middle portion of the motor holding plate 10 in a width direction, is curved. An end of the curved portion constitutes an engaging portion 10*a*. The curved portion has some elasticity. When the motor holding plate 10 is moved from the open position (A shown in FIG. 6) to the close position (B shown in FIG. 6) by rotating it around the transversal shaft 9, the curved portion is inserted into a hole portion 11 provided on a rear side of the motor containing part 7 of the chassis 2. The engaging portion 10*a* is engageable with an edge (engaging portion) 11*a* of the hole portion 11 by using the elasticity of the motor holding plate 10.

Figure 7:
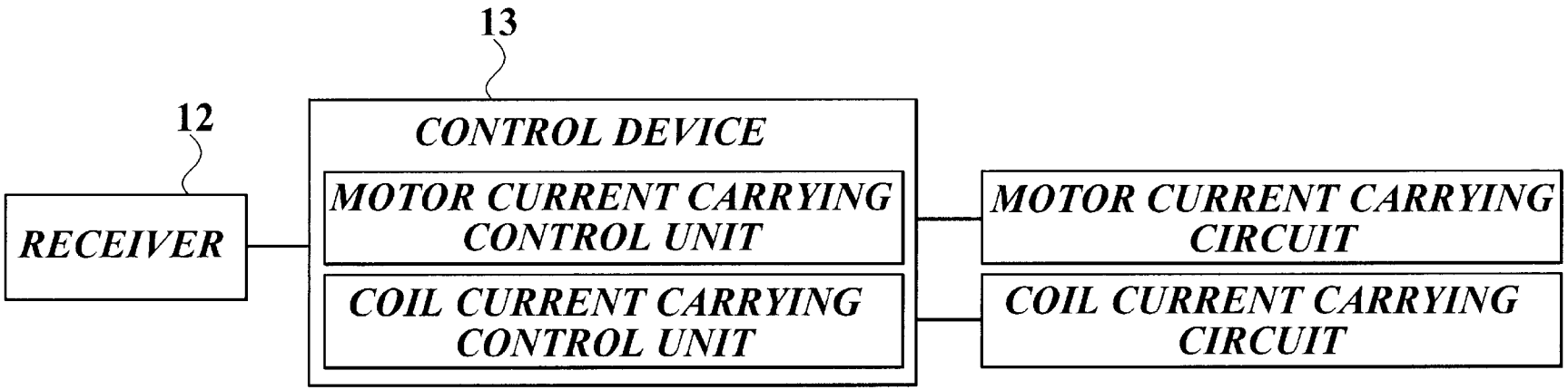
FIG. 7 is a drawing showing an internal circuit of the vehicle toy shown in FIG. 1.

FIG. 7 is a block diagram showing an internal circuit of the vehicle toy 1. The vehicle toy 1 comprises a receiver 12 for receiving a control signal outputted from a remote controller (which is not shown in the figure) via an antenna (which is not shown in the figure), and a control device 13 for controlling the current to be carried to the motor 8 and the coil 14, of the vehicle toy 1, in accordance with the control signal received by the receiver 12. The control device 13 is arranged on a printed wiring board which is not shown in the figure. The printed wiring board is disposed above the battery 4.

Figure 8:
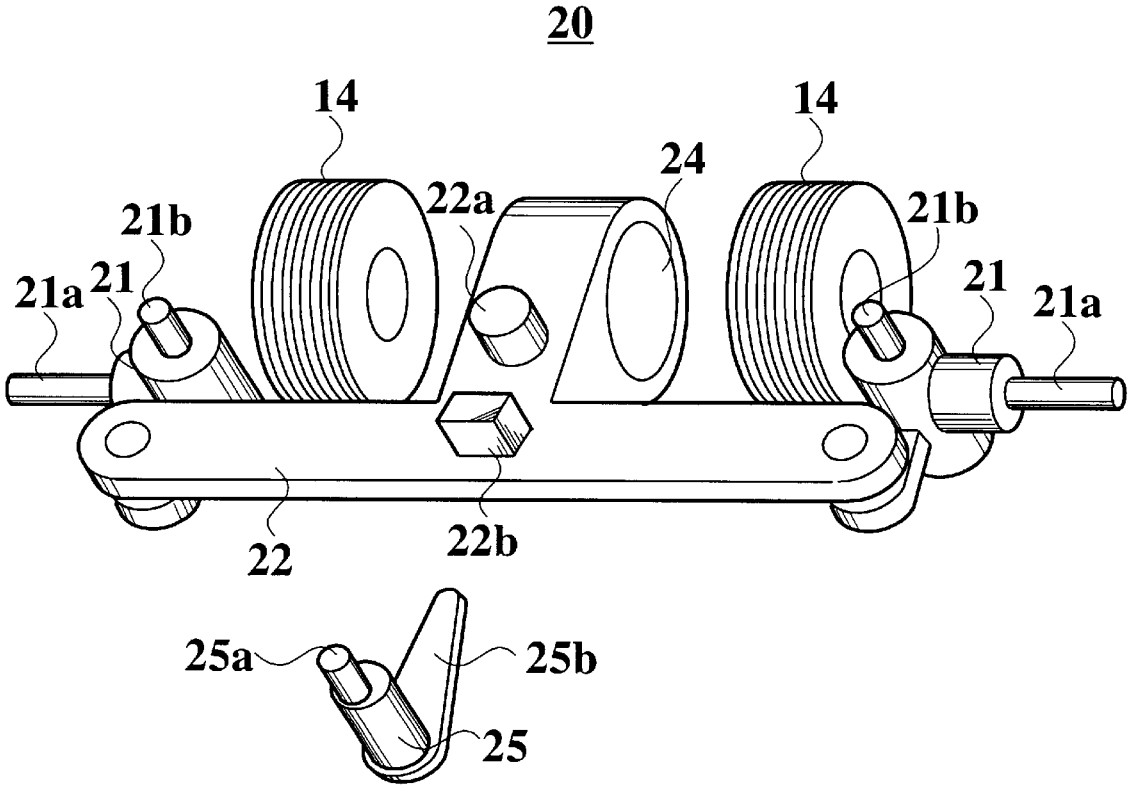
FIG. 8 is a perspective view showing a steering device of the vehicle toy shown in FIG. 1.

Next, the steering device of the vehicle toy 1 will be explained in detail. As shown in FIG. 8, the steering device 20 of the vehicle toy 1 comprises right and left knuckle arms (turning member) 21 on which the right and left front wheels 2*c* are provided respectively, and a tie rod (connecting member) 22 for connecting the right and left knuckle arms with each other.

Figure 9:
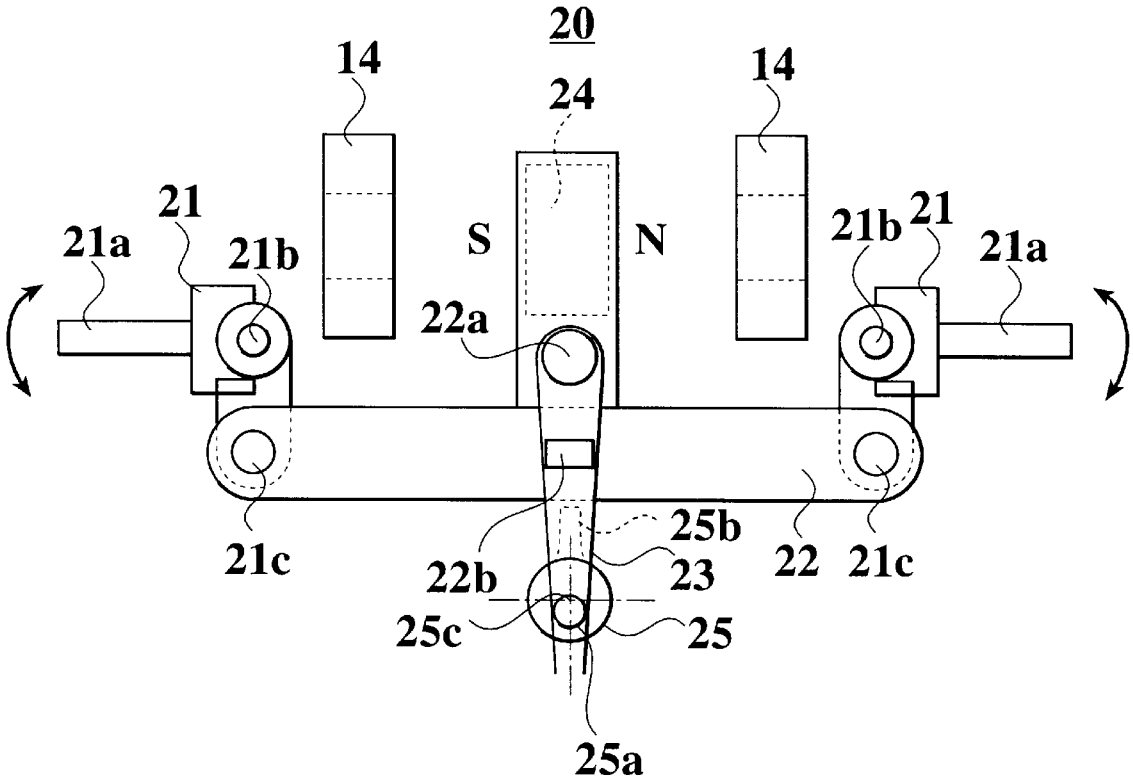
FIG. 9 is a plan view of a steering device showing the vehicle toy shown in FIG. 1.
Figure 11:
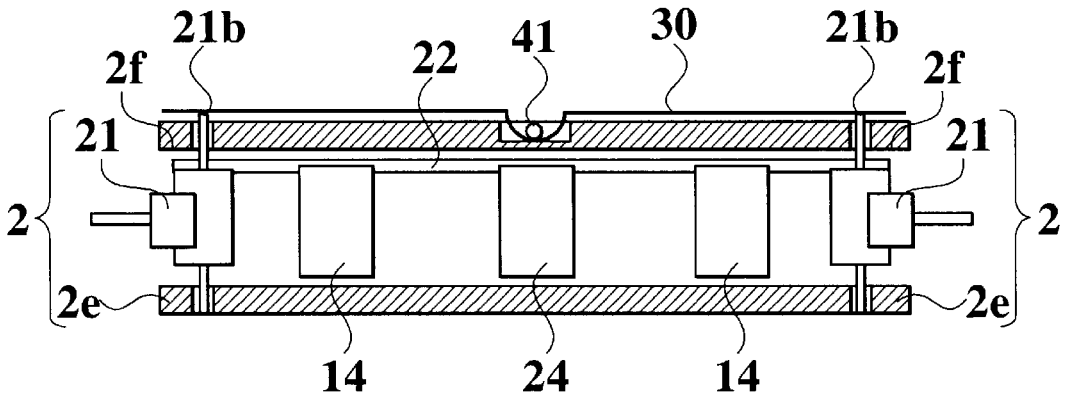
FIG. 11 is a sectional view from the front side, which shows a suspension of the vehicle toy shown in FIG. 1.

A front wheel shaft 21*a* is provided on each knuckle arm 21. Front wheels 2*c* are attached to the front wheel shaft 21*a* so as to idle it. As shown in FIG. 9, the right and left knuckle arms 21 are supported by the chassis 2 so as to be turnable around each of right and left shafts 21*b*, respectively. An upper edge portion and the lower edge portion of the right and left shafts 21*b* are inserted into a hole portion (which is not shown in the figure) of a lower chassis 2*e* and that of an upper chassis 2*f*, respectively, as shown in FIG. 11. The hole portion into which the upper edge portion of the shaft 21*a* is inserted, penetrates through the upper chassis 2*f* vertically. The right and left knuckle arms 21 are slightly movable vertically between the lower chassis 2*e* and the upper chassis 2*f*. On the other hand, the tie rod 22 constructs turning pairs with the free end portion of the knuckle arm 21 at the portions of the shaft 21*c* provided on both edge portions of the tie rod 22. As a result, when the tie rod 22 moves in right and left directions, each of the right and left knuckle arms 21 is turned around the shaft 21*b*. The directions of the right and left front wheels 2*c* are changed.

A torsion spring 23 is provided on the tie rod 22. A spiral portion of a head part of the torsion spring 23 is set to a projection 22*a* provided on the tie rod 22. Each middle portion of a rod portion formed on both sides of the torsion spring 23 is hung so as to sandwich the projection 22*b* provided on the tie rod 22. An end portion of the torsion spring 23 is hung by a trim (fixing portion) 25 provided behind the tie rod 22. In the concrete, the end portion of the torsion spring 23 is hung by an eccentric cam 25*a* of the trim 25. The eccentric cam 25*a* is turned around the shaft line 25*c* by turning the lever 25*b* exposed under the chassis 2, in clockwise and counterclockwise directions around the shaft line 25*c*. A neutral position of the tie rod 22 can be finely adjusted by this turning. The torsion coil spring 23 keeps the tie rod 22 in a position (neutral position) which is not biased in either right or left directions.

A permanent magnet 24 is disposed on a front side of the tie rod 22. The permanent magnet 24 is formed in a disk shape, and is disposed so as to direct both side surfaces thereof to right and left directions. One side surface of the permanent magnet 24 is an S pole. The other side surface is a N pole. Two coils 14 are provided in front of the tie rod 22 on the right and left sides. The coil 14 is a round air core coil in which a core does not exist. One end portion of each coil 14 faces to the side surface of the permanent magnet 24 disposed on the tie rod 22. Needless to say, a coil having a core can be also used here. The reason why a disk-shaped permanent magnet and a round air core coil are used is that the whole toy is downsized and lightened by not inserting a core into a coil. In case of the round air core coil, a magnetic force to be generated by the coil is weak. However, this problem is solved by using the torsion spring coil 23 having a slight biasing force.

Figure 10:
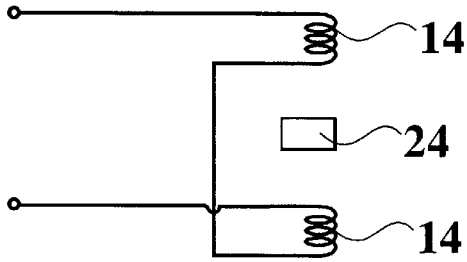
FIG. 10 is a view showing a part of a coil current carrying circuit of the vehicle toy shown in FIG. 1.

FIG. 10 shows a part of the coil current carrying circuit. A current carrying operation of the coil current carrying circuit is controlled by the coil current carrying control unit. The coil current carrying circuit is constructed so as to carry the current to the right and left coils 14 simultaneously. The coil current carrying circuit is constructed so that each side of the right and left coils 14, which faces to each side surface of the permanent magnet 24 becomes the same pole (N pole or S pole) when the current is carried to the right and left coils 14 simultaneously. Therefore, when the current is carried to the right and left coils 14, an attractive force is generated between one coil 14 and the permanent magnet 24 and a repulsive force is generated between the other coil 14 and the permanent magnet 24. As a result, the tie rod 22 is moved against the biasing force of the torsion spring 23. In this case, in order to change the moving direction of the tie rod 22, the direction of the current to be carried to the coils 14 may be changed by the coil current carrying control unit.

Alternatively, the coil current carrying circuit may be constructed so that the current is selectively carried to one of the right and left coils 14. Then, the tie rod 22 may be moved by an attractive force or a repulsive force, which is generated between the coil 14 to which the current is carried, and the permanent magnet 24.

FIG. 11 shows a suspension for the vehicle toy according to the present invention. The suspension 40 comprises a metal leaf spring (biasing member) 30. The leaf spring 30 is disposed on the upper chassis 2*f*. A middle portion of the leaf spring 30 is curved in a U-shape. The curved portion is slightly held by a shaft 41 provided on the upper chassis 2*f*. On the other hand, the right and left edge portions of the leaf spring 30 are arranged on hole portions for inserting each upper edge portion of the shafts 21*b* therein and are in contact with the shafts 21*b*.

Figure 12A:
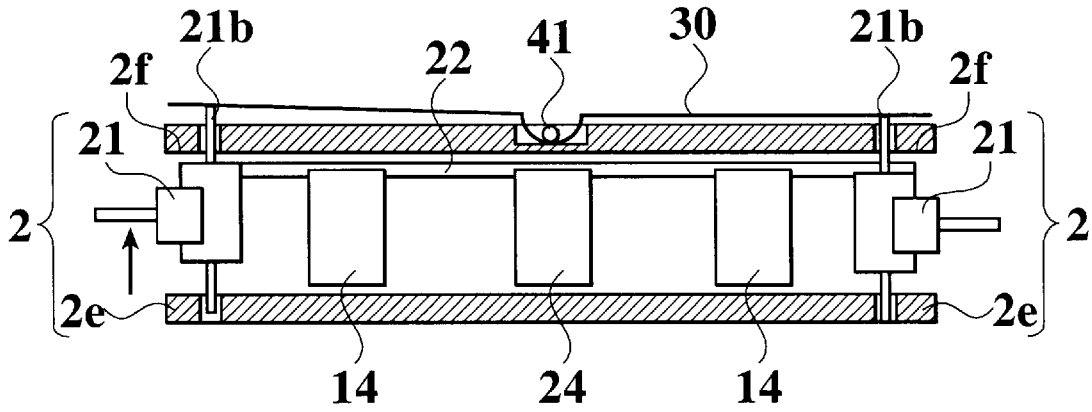
FIG. 12A and FIG. 12B are views showing each operating state of the suspension shown in FIG. 11.
Figure 12B:
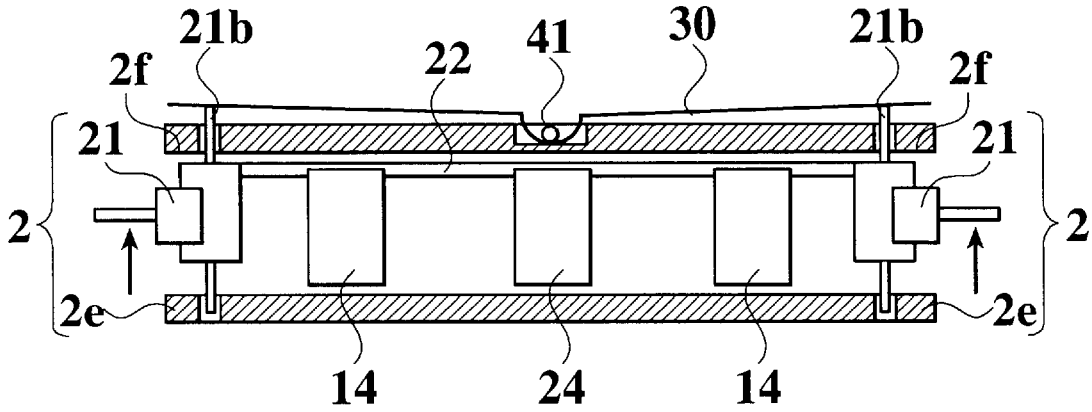

FIGS. 12A and 12B show operating states of the suspension shown in FIG. 11. As shown in FIG. 12A, when one side (which is indicated by an arrow) front wheel 2*c* is moved up, one side portion of the leaf spring 30 (portion from the shaft 41 to the front wheel 2*c* which is moved up) is bent. As shown in FIG. 12B, when both side front wheels 2*c* are moved up, both side portions of the leaf spring 30, which are extended from the shaft 41, are bent. Thereby, the leaf spring 30 can absorb a shock from a road surface, which is caused in accordance with bumps of a running surface for the front wheels 2*c* of the vehicle toy 1. Further, the wheels can be properly contacted with a running surface.

Figure 13:
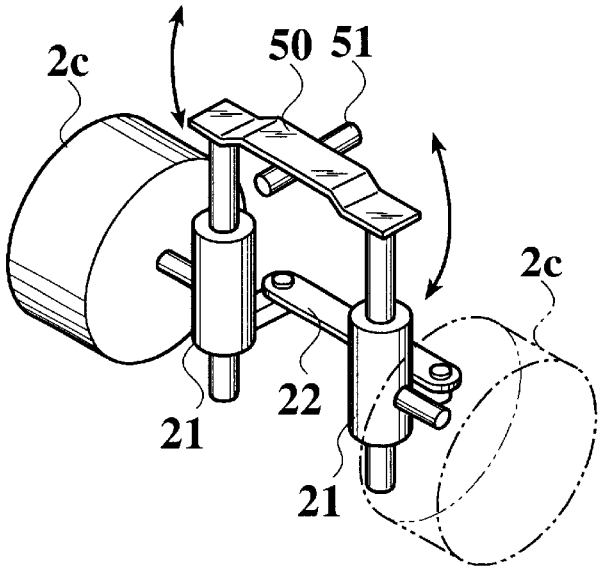
FIG. 13 is a perspective view from the front side, which shows another embodiment of a suspension of the vehicle toy shown in FIG. 1.

FIG. 13 shows a structure of another suspension of the vehicle toy 1. This suspension is different from the suspension shown in FIG. 12 in the point that a metal leaf spring (biasing member; which corresponds to the leaf spring 30) 50 and a shaft (which corresponds to the shaft 41) 51 are unitedly formed.

This suspension has the same function and effect as the suspension shown in FIG. 12.

Figure 14:
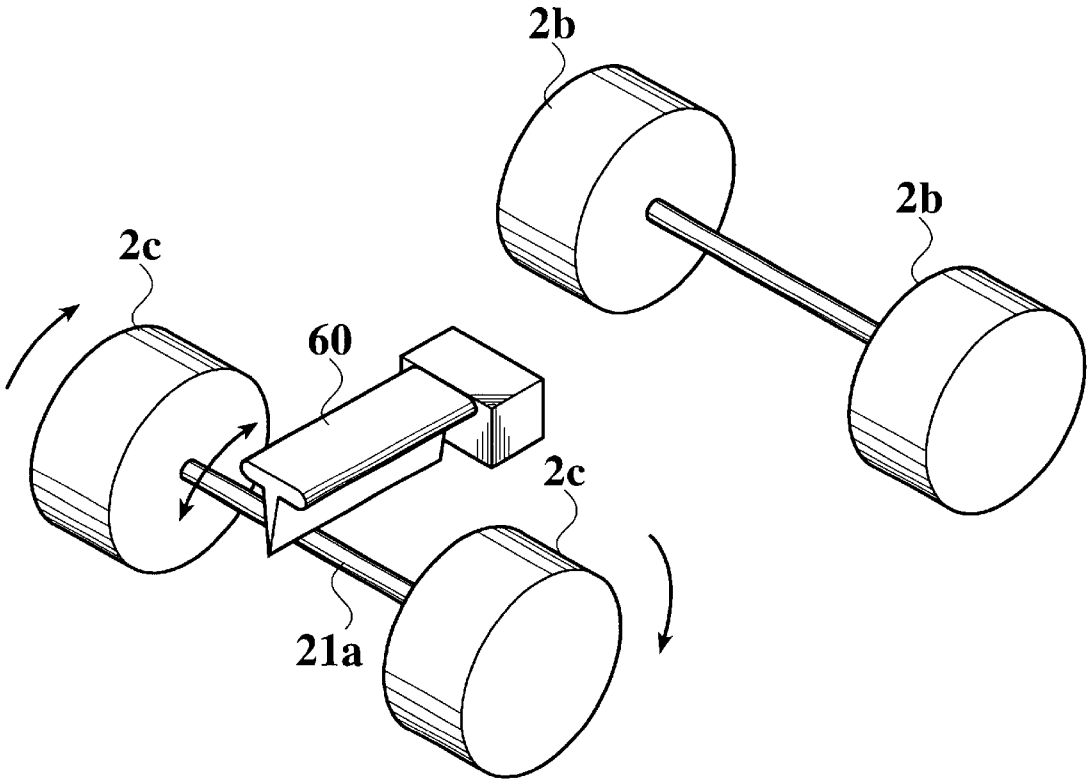
FIG. 14 is a perspective view from the front side, which shows still another embodiment of a suspension of the vehicle toy shown in FIG. 1.
Figure 15:
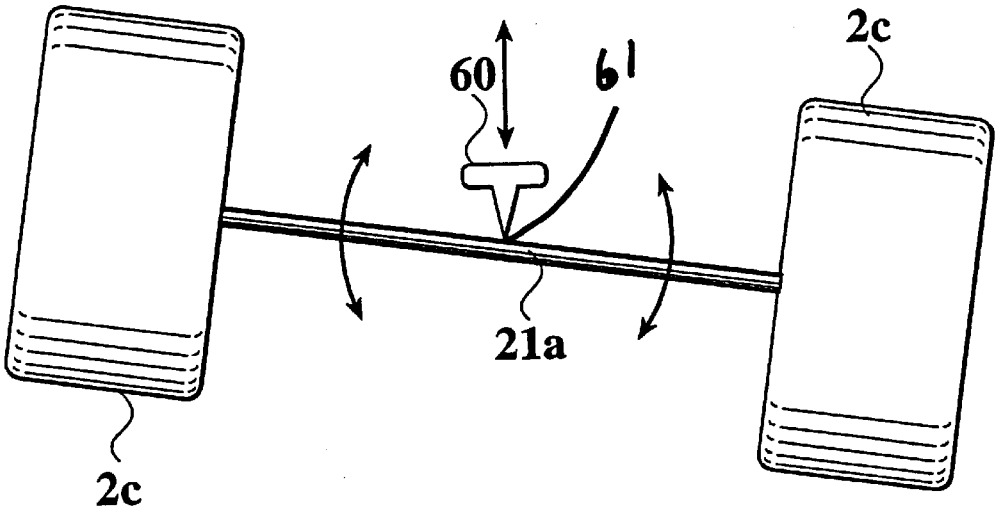
FIG. 15 is a view showing an operating state of the suspension shown in FIG. 14.

FIGS. 14 and 15 show still another suspension of the vehicle toy 1. This suspension is used for a vehicle toy comprising the front wheel shaft 21*a* provided with the wheels (front wheel) 2*c* at right and left thereof. In this suspension, the front wheel shaft 21*a* is constructed so as to be movable vertically in a predetermined range. In order to move the front wheel shaft vertically, for example, a notch into which the front wheel shaft 21*a* is inserted, may be formed longitudinally on the side wall of the chassis 2.

A metal biasing member 60 is provided to contact the front wheel shaft 21*a* at a contact portion at the middle of a width direction of the front wheel shaft 21*a*. The biasing member 60 is constructed so as to be elastically deformable vertically, and contacts with the front wheel shaft 21*a* in the middle of a width direction of the vehicle toy 1. In this suspension, the front wheel shaft 21*a* can perform a seesaw motion by using a contact portion 61 with the biasing member 60 as a fulcrum (see FIG. 15). The front wheel shaft 21*a* is kept in a neutral position when the road surface is flat.

By using this suspension, even when the front wheel shaft 21*a* is swung by using the biasing member 60 as the fulcrum, according to the bumps of the road surface, the front wheel shaft 21*a* is pressed by using a biasing force which is caused by elastically deforming the biasing member 60, and the right and left wheels 2*c* can be grounded properly to the road surface.

Figure 16:
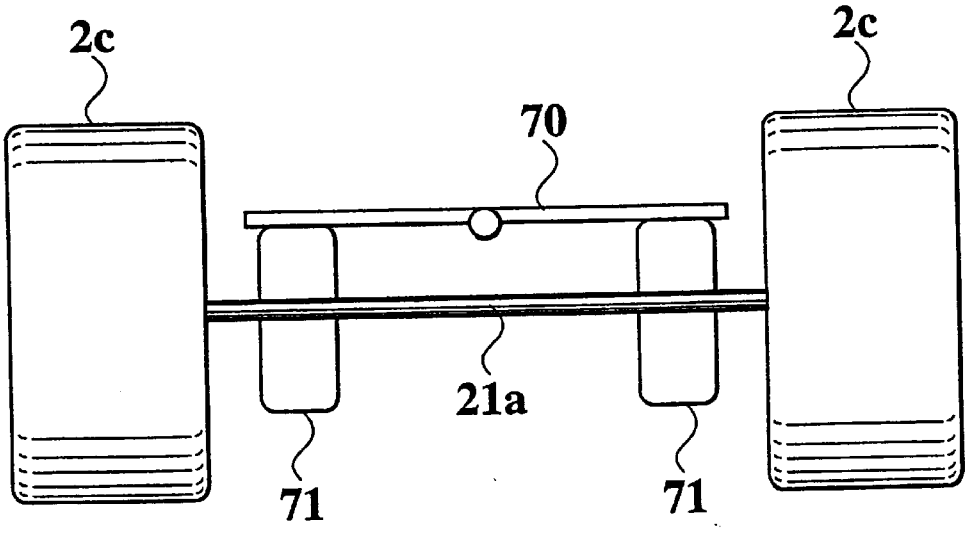
FIG. 16 is view from the front side, which shows still another embodiment of a suspension of the vehicle toy shown in FIG. 1.

FIG. 16 shows a still another suspension of the vehicle toy 1. This suspension is used for a vehicle toy comprising a front wheel shaft 21*a* provided with wheels 2*c* at right and left thereof. In this suspension, the front wheel shaft 21*a* is constructed so as to be movable vertically in a predetermined range. In order to move the front wheel shaft vertically, for example, a notch into which the front wheel shaft 21*a* is inserted, may be formed longitudinally on the side wall of the chassis 2.

A metal leaf spring (biasing member; which corresponds to the leaf spring 50) 70 is provided above the front wheel shaft 21*a*. Each of right and left edge portions of the biasing member 70 is constructed so as to be elastically deformable vertically, and contacts with a roller bearing portion (which is movable vertically with the front wheel shaft 21*a*) 71 of the right and left edge portions of the front wheel shaft 21*a*.

By using this suspension, even when the front wheel shaft 21*a* is moved by the bumps of the road surface, the front wheel shaft 21*a* is pressed by a biasing force which is caused by elastically deforming the biasing member 70, and the right and left wheels 2*c* can be grounded properly to the road surface.

As described above, the embodiments of the present invention are explained. However, the present invention is not limited to the above embodiments. Therefore, various other changes may be suitably made without departing from the gist of the present invention.

For example, in the above embodiments, the permanent magnet is provided on the tie rod, and the coils are provided on the both sides of the permanent magnet. However, a coil may be provided on the tie rod, and permanent magnets may be provided on the both sides of the coil. In essence, the toy has a structure that the tie rod can be moved to the right and the left by using a magnetic force caused between a coil and a permanent magnet.

Moreover, although the permanent magnet is provided as a magnetic material in the above embodiment, a magnetic material which is not magnetized may be provided instead of the permanent magnet.

Moreover, although the biasing members, such as a leaf spring, is formed out of metal in the above embodiment, other materials, such as, plastic or the like may be used for the biasing members.

As described above, the right and left wheels are grounded properly by using a biasing force which is caused by elastically deforming the biasing member. In addition, the structure of a suspension becomes simpler than that of a former suspension.

The entire disclosure of Japanese Patent Application No. Tokugan 2000-370363 filed on Dec. 5, 2000 including specification, claims drawings and summary are incorporated herein by reference in its entirety.

What is claimed is:

1. A suspension for a running toy, comprising:

right and left turning members which turn right and left wheels in horizontally clockwise and counterclockwise directions around right and left shafts, respectively;

a connecting member which connects the right and left turning members with each other, and which forms a turning pair with each of the right and left turning members; and a leaf spring which is located on an upper surface of an upper chassis, a middle portion of the leaf spring in a width direction being supported by the upper chassis;

wherein the right and left turning members are located between and supported by the upper chassis and a lower chassis to be slightly movable therebetween so that upper portions and lower portions of the right and left shafts are loosely inserted into hole portions formed in the upper and lower chassis, respectively, and top ends of the upper portions of the right and left shafts project vertically from the upper surface of the upper chassis through the hole portions thereof and are in contact with a lower surface of the leaf spring to be subjected to a downward biasing force caused by elastically deforming the leaf spring.

2. A running toy comprising the suspension as claimed in claim 1.

3. The running toy as claimed in claim 2, wherein the leaf spring is detachable.

4. The suspension as claimed in claim 1, wherein the leaf spring comprises a curved middle portion at which the leaf spring is held on the upper chassis.

5. The suspension as claimed in claim 4, wherein the upper chassis comprises a recess portion formed in the upper surface of the upper chassis at a middle portion thereof, in which the curved middle portion of the leaf spring is held on the upper chassis.

6. The suspension as claimed in claim 5, wherein the curved middle portion of the leaf spring is sandwiched between the recess portion of the upper chassis and a shaft located on the upper chassis.

7. The suspension as claimed in claim 1, wherein the leaf spring comprises metal or plastic.

8. A suspension for a running toy having a wheel shaft for attaching right and left wheels, comprising:

a biasing member which is elastically deformable vertically, and which contacts a contact portion of the wheel shaft at a middle of the wheel shaft; and the wheel shaft being constructed to be movable vertically in a predetermined range, and to perform a seesaw motion by using the contact portion with the biasing member as a fulcrum;

wherein the wheel shaft is pressed at the contact portion by using a biasing force which is caused by elastically deforming the biasing member, so that the right and left wheels are grounded to a road surface.

9. A running toy comprising the suspension as claimed in claim 8.

10. The running toy as claimed in claim 9, wherein the biasing member is detachable.

11. A suspension for a running toy, comprising:

a leaf spring on a top of an upper chassis, supported at a middle portion between right and left wheels;

right and left wheel turning members on right and left vertical shafts inserted loosely into apertures of the upper chassis and a lower chassis, wherein top ends of the shafts project vertically through the upper chassis, biasing against a bottom of the leaf spring; and a tie rod connecting and forming a turning pair with each of the turning members.

12. A running toy comprising the suspension as claimed in claim 11.

* * * * *

US006656011C1

(12) INTER PARTES REEXAMINATION CERTIFICATE (0076th)

United States Patent

Yoneda

(10) Number: US 6,656,011 C1

(45) Certificate Issued: Jun. 30, 2009

(54) SUSPENSION FOR RUNNING TOY AND RUNNING TOY

(75) Inventor: Yousuke Yoneda, Tokyo (JP)

(73) Assignee: Tomy Company, Ltd., Katsushiki-Ku, Tokyo (JP)

Reexamination Request:
No. 95/000,036, Feb. 20, 2004

Reexamination Certificate for:

| | |
|---|---|
| Patent No.: | **6,656,011** |
| Issued: | **Dec. 2, 2003** |
| Appl. No.: | **10/056,110** |
| Filed: | **Jan. 28, 2002** |

(51) Int. Cl.
*A63H 17/00* (2006.01)

(52) U.S. Cl. ..... 446/431; 446/454; 446/468

(58) Field of Classification Search ..... 267/52, 267/158, 247, 243, 229, 47
See application file for complete search history.

(56) References Cited

U.S. PATENT DOCUMENTS

| | | | | |
|---|---|---|---|---|
| 1,739,917 | A | | 12/1929 | Rayzor |
| 2,473,519 | A | | 6/1949 | Gillitzer |
| 2,913,253 | A | | 11/1959 | Taber |
| 3,027,682 | A | | 4/1962 | Schlau |
| 3,083,499 | A | * | 4/1963 | Balthazor ..... 446/466 |
| 3,749,389 | A | * | 7/1973 | Duchemin ..... 267/52 |
| 3,751,065 | A | | 8/1973 | Sullivan |
| 3,752,248 | A | | 8/1973 | Sullivan |
| 3,774,340 | A | | 11/1973 | Barlow et al. |
| 3,939,605 | A | * | 2/1976 | Allen ..... 446/448 |
| 4,159,126 | A | | 6/1979 | Raleigh |
| 4,171,592 | A | | 10/1979 | Saitoh |
| 4,197,672 | A | | 4/1980 | Mabuchi et al. |
| 4,248,012 | A | | 2/1981 | Kirby et al. |
| 4,573,941 | A | | 3/1986 | Holden et al. |
| 4,647,067 | A | | 3/1987 | Paquette et al. |
| 4,762,511 | A | | 8/1988 | Lee et al. |
| 4,893,832 | A | | 1/1990 | Booher |
| 5,141,209 | A | | 8/1992 | Sano et al. |
| 5,265,902 | A | | 11/1993 | Lewis |
| 5,281,184 | A | | 1/1994 | Suimon |
| 5,306,038 | A | | 4/1994 | Henderson, Jr. |

(Continued)

FOREIGN PATENT DOCUMENTS

| | | | |
|---|---|---|---|
| GB | 1095490 | * | 12/1967 |
| GB | 2187108 | | 9/1987 |
| GB | 2275206 | | 6/1994 |
| JP | 38-16765 | * | 8/1963 |
| JP | 58-115296 | | 8/1983 |
| JP | S61-002884 | * | 1/1986 |
| JP | 1-159893 | | 11/1989 |
| JP | 1-172894 | * | 12/1989 |
| JP | 7-299255 | | 11/1995 |
| JP | 3030650 | | 8/1996 |
| JP | 10-085463 | | 4/1998 |
| JP | 2001-353379 | | 12/2001 |

*Primary Examiner*—Matthew C. Graham

(57) ABSTRACT

The present invention provides a suspension for a toy and a vehicle toy, which can properly ground right and left wheels. A suspension for a running toy comprises: right and left turning members for turning right and left wheels in clockwise and counterclockwise directions around each predetermined shaft; a connecting member for connecting the right and left turning members with each other, and for constituting a turning pair with each of the right and left turning members; and a biasing member having right and left edge portions, which is supported in a middle of a width direction of the running toy, and which extends on the right and left turning members, the right and left edge portions being elastically deformable vertically; wherein the right and left turning members are turned around the predetermined shaft by shaking the connecting member in right and left directions; the right and left turning members are constructed so as to be movable vertically in a predetermined range; and the turning members are pressed with the right and left edge portions by using a biasing force which is caused by elastically deforming the biasing member, so that the right and left wheels are grounded to a road surface.

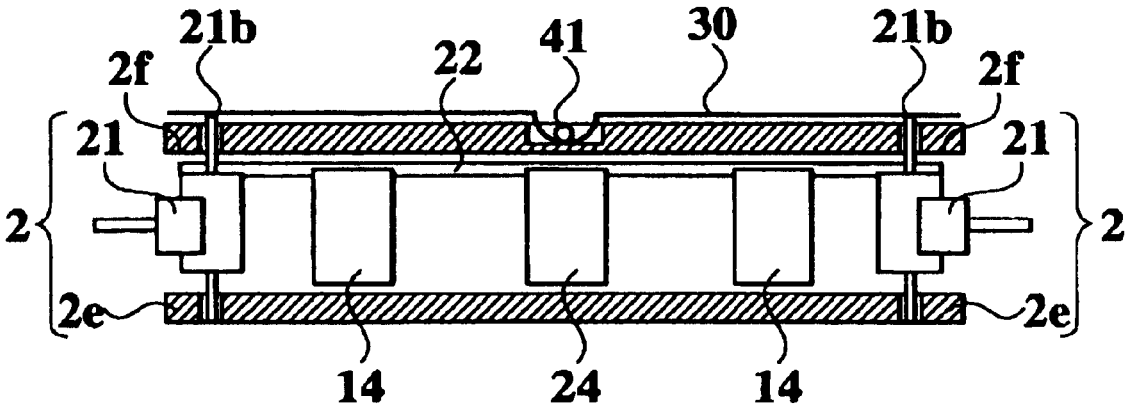

U.S. PATENT DOCUMENTS

| | | | |
|---|---|---|---|
| 5,322,469 | A | 6/1994 | Tilbor |
| 5,338,246 | A | 8/1994 | Suto |
| 5,338,247 | A | 8/1994 | Miles |
| 5,478,104 | A | 12/1995 | Worrel et al. |
| 5,775,972 | A | 7/1998 | Siu |
| 5,785,576 | A | 7/1998 | Belton |
| 5,947,795 | A | 9/1999 | Cohen |
| 6,419,547 | B1 | 7/2002 | Hartelius |
| 6,428,025 | B1 | 8/2002 | Suh |
| 6,478,655 | B2 | 11/2002 | Wu |
| 6,599,169 | B2 | 7/2003 | Edmisson et al. |
| 6,827,627 | B2 | 12/2004 | Tsang |
| 2002/0077025 | A1 | 6/2002 | Wu |

* cited by examiner

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 7, lines 28–39:

FIGS 12A and 12B show operating states of the suspension shown in FIG. 11. As shown in FIG. 12A, when one side (which is indicated by an arrow) front wheel 2c is moved up, one side portion of the leaf spring 30 (portion from the shaft 41 to the front wheel 2c which is moved up) is bent. As shown in FIG. 12B, when both side front wheels 2c are moved up, both side portions of the leaf spring 30, which are extended from the shaft 41, are bent. *Thus, the leaf spring 30 ends can move individually to bias each turning member 21 separately.* Thereby, the leaf spring 30 can absorb a shock from a road surface, which is caused in accordance with bumps of a running surface for the front wheels 2c of the vehicle toy 1. Further, the wheels can be properly contacted with a running surface.

AS A RESULT OF REEXAMINATION, IT HAS BEEN DETERMINED THAT:

The patentability of claims 5–6 is confirmed.

Claims 1–4 and 7–12 are cancelled.

New claims 13–30 are added and determined to be patentable.

*13. A suspension for a running toy, comprising:*

*right and left turning members which turn right and left wheels in horizontally clockwise and counterclockwise directions around right and left shafts, respectively;*

*a connecting member which connects the right and left turning members with each other, and which forms a turning pair with each of the right and left turning members; and*

*a leaf spring which is located on an upper surface of an upper chassis, a middle portion of the leaf spring in a width direction being supported in the upper surface of the upper chassis;*

*wherein the right and left turning members are located between and supported by the upper chassis and a lower chassis to be slightly movable therebetween so that upper portions and lower portions of the right and left shafts are loosely inserted into hole portions formed in the upper and lower chassis, respectively, and top ends of the upper portions of the right and left shafts project vertically from the upper surface of the upper chassis through the hole portions thereof and are in contact with a lower surface of the leaf spring to be subjected to a downward biasing force caused by elastically deforming the leaf spring, and*

*wherein the respective ends of the leaf spring can move individually to bias each turning member separately.*

*14. A running toy comprising the suspension as claimed in claim 13.*

*15. The running toy as claimed in claim 14, wherein the leaf spring is detachable.*

*16. The suspension as claimed in claim 13, wherein the leaf spring comprises a curved middle portion at which the leaf spring is held on the upper chassis.*

*17. The suspension as claimed in claim 16; wherein the upper chassis comprises a recess portion formed in the upper surface of the upper chassis at a middle portion thereof, in which the curved middle portion of the leaf spring is held on the upper chassis.*

*18. The suspension as claimed in claim 17, wherein the curved middle portion of the leaf spring is sandwiched between the recess portion of the upper chassis and a shaft located on the upper chassis.*

*19. The suspension as claimed in claim 13, wherein the leaf spring comprises metal or plastic.*

*20. A suspension for a running toy, comprising:*

*right and left turning members which turn right and left wheels in horizontally clockwise and counterclockwise directions around right and left shafts, respectively;*

*a connecting member which connects the right and left turning members with each other, and which forms a turning pair with each of the right and left turning members; and*

*a leaf spring which is located on an upper surface of an upper chassis, and which has a curved middle portion and two side portions in a width direction, said middle portion being supported by the upper chassis,*

*wherein the middle portion of the leaf spring is substantially fixed in a vertical direction but the side portions are allowed to individually move vertically,*

*wherein the right and left turning members are located between and supported by the upper chassis and a lower chassis to be slightly movable therebetween so that upper portions and lower portions of the right and left shafts are loosely inserted into hole portions formed in the upper and lower chassis, respectively, and top ends of the upper portions of the right and left shafts project vertically from the upper surface of the upper chassis through the hole portions thereof and are in contact with a lower surface of each side portion of the leaf spring to be subjected to a download biasing force caused by elastically deforming the leaf spring, and*

*wherein the upper chassis comprises a recess portion formed in the upper surface of the upper chassis at a middle portion thereof, in which the curved middle portion of the leaf spring is held on the upper chassis.*

*21. The suspension as claimed in claim 20, wherein the curved middle portion of the leaf spring is sandwiched between the recess portion of the upper chassis and a shaft located on the upper chassis.*

*22. A suspension for a running toy, comprising:*

*right and left turning members which turn right and left wheels in horizontally clockwise and counterclockwise directions around right and left shafts, respectively;*

*a connecting member which connects the right and left turning members with each other, and which forms a turning pair with each of the right and left turning members; and*

*a leaf spring which is located on an upper surface of an upper chassis, a middle portion of the leaf spring in a width direction being supported by the upper chassis;*

*wherein the right and left turning members are located between and supported by the upper chassis and a lower chassis to be slightly movable therebetween so that upper portions and lower portions of the right and left shafts are loosely inserted into hole portions formed in the upper and lower chassis, respectively, and top ends of the upper portions of the right and left shafts project vertically from the upper surface of the upper chassis through the hole portions thereof and are in contact with a lower surface of the leaf spring to be subjected to a downward biasing force caused by elastically deforming the leaf spring, and*

*wherein the upper chassis comprises a recess portion formed in the upper surface of the upper chassis at a middle portion thereof, in which the middle portion of the leaf spring is held on the upper chassis.*

*23. The suspension as claimed in claim 22, wherein the middle portion of the leaf spring is sandwiched between the recess portion of the upper chassis and a shaft located on the upper chassis.*

*24. A suspension for a running toy, comprising:*

*right and left turning members which turn right and left wheels in horizontally clockwise and counterclockwise directions around right and left shafts, respectively;*

*a connecting member which connects the right and left turning members with each other, and which forms a turning pair with each of the right and left turning members; and*

*a leaf spring which has left and right ends, and a middle portion supported in a recess formed in an upper surface of the upper chassis by a shaft attached to the upper chassis;*

*wherein the right and left turning members are located between and supported by the upper chassis and a lower chassis to be slightly movable therebetween so that upper portions and lower portions of the right and left shafts are loosely inserted into hole portions formed in the upper and lower chassis, respectively, and top ends of the upper portions of the right and left shafts project vertically from the upper surface of the upper chassis through the hole portions thereof and are in contact with a lower surface of the ends of the leaf spring to be subjected to a downward biasing force of the leaf spring, and*

*wherein the respective ends of the leaf spring can move individually to bias each turning member separately.*

*25. A suspension for a running toy, comprising:*

*right and left turning members which turn right and left wheels in horizontally clockwise and counterclockwise directions around right and left shafts, respectively;*

*a connecting member which connects the right and left turning members with each other, and which forms a turning pair with each of the right and left turning members; and*

*a leaf spring which is located at an upper surface of an upper chassis, and which has a middle portion that is supported in the upper surface by a first shaft received by the upper chassis, and left and right side portions, each side portion extending from the middle portion to an edge portion of the leaf spring;*

*wherein the right and left turning members are located between and supported by the upper chassis and a lower chassis to be slightly movable therebetween so that upper portions and lower portions of the right and left shafts are loosely inserted into hole portions formed in the upper and lower chassis, respectively, and top ends of the upper portions of the right and left shafts project vertically from the upper surface of the upper chassis through the hole portions thereof and are in contact with a lower surface of the leaf spring to be subjected to a downward biasing force of the leaf spring,*

*wherein, when the left front turning member is moved up, the left side portion moves upwardly, relative to the first shaft, against the biasing force of the leaf spring, and, individually, when the right front turning member is moved up, the right side portion moves upwardly, relative to the first shaft, against the biasing force of the leaf spring.*

*26. The suspension as recited in claim 25, wherein, when both front turning members are moved up, both side portions of the leaf spring move upwardly.*

*27. A running toy comprising the suspension as claimed in claim 5.*

*28. A running toy comprising the suspension as claimed in claim 20.*

*29. A running toy comprising the suspension as claimed in claim 22.*

*30. A running toy comprising the suspension as claimed in claim 24.*

* * * * *